US009293865B2

(12) United States Patent
Schwandt

(10) Patent No.: US 9,293,865 B2
(45) Date of Patent: Mar. 22, 2016

(54) HIGH DIGITAL BANDWIDTH CONNECTION APPARATUS

(71) Applicant: BlackBerry Limited, Waterloo Ontario (CA)

(72) Inventor: Sheldon Terry Schwandt, Wellesley, CA (US)

(73) Assignee: BlackBerry Limited, Waterloo, Ontario (CA)

( * ) Notice: Subject to any disclaimer, the term of this patent is extended or adjusted under 35 U.S.C. 154(b) by 165 days.

(21) Appl. No.: 14/048,386

(22) Filed: Oct. 8, 2013

(65) Prior Publication Data

US 2015/0099400 A1 Apr. 9, 2015

(51) Int. Cl.
*H01R 24/00* (2011.01)
*H01R 13/6476* (2011.01)
*H01R 24/62* (2011.01)

(52) U.S. Cl.
CPC ..... *H01R 13/6476* (2013.01); *H01R 24/62* (2013.01)

(58) Field of Classification Search
USPC ..... 439/218, 660, 941
IPC ..... H01R 27/00,31/06, 2103/00, 23/7073, H01R 23/02, 23/725, 23/05, 23/025
See application file for complete search history.

(56) References Cited

U.S. PATENT DOCUMENTS 5,309,630 A * 5/1994 Brunker et al. ..... 29/842
5,425,658 A * 6/1995 White ..... 439/637
6,206,734 B1 3/2001 Liu
6,312,292 B2 11/2001 Liu
6,350,158 B1 2/2002 Arnett et al.
6,530,810 B2 3/2003 Goodrich et al.
7,033,221 B2 4/2006 Bricaud et al.
7,329,154 B2 * 2/2008 Koyama ..... 439/660
7,465,194 B1 * 12/2008 Ho et al. ..... 439/607.01
7,485,009 B1 * 2/2009 Zhu ..... 439/660
8,011,963 B2 9/2011 Atkinson et al.
2007/0141890 A1 6/2007 Koyama
2010/0203768 A1 8/2010 Kondo et al.
2013/0012071 A1 1/2013 Nakazura et al.

OTHER PUBLICATIONS

Rodda, M., et al., "Universal Serial Bus Micro-USB Cables and Connectors Specification," MicroUSB Specification to the USB 2.0 Specification, Revision 1.01, Apr. 4, 2007, pp. 1-36.Copyright 2007 USB Implementers Forum, Inc. (USB-IF).
Extended European Search Report dated Feb. 23, 2015, received for European Application No. 14188037.7.

* cited by examiner

*Primary Examiner* — Hien Vu
(74) *Attorney, Agent, or Firm* — Jon Gibbons; Fleit Gibbons Gutman Bongini & Bianco P.L.

(57) ABSTRACT

A multiple connector socket is able to interface to a low bandwidth connector and a high bandwidth connector. The low bandwidth connector facilitates a low bandwidth interface, such as USB 2.0, using a miniaturized connector having low bandwidth blade contacts, such as a micro USB 2.0 connector. The high bandwidth connector interposes high bandwidth blade contacts between the low bandwidth blade contacts for facilitating a high bandwidth interface, such as components of a DisplayPort interface. The high bandwidth blade contacts incorporate apertures to reduce electromagnetic coupling with the low bandwidth blade contacts. In one implementation, apertures are not required on the low bandwidth blade contacts.

20 Claims, 7 Drawing Sheets

HIGH DIGITAL BANDWIDTH CONNECTION APPARATUS

FIELD OF THE DISCLOSURE

The present disclosure generally relates to connectors for data communications and power coupling, and more particularly to miniaturized high digital bandwidth connectors.

BACKGROUND

Electronic devices are incorporating increasing amounts of data processing capabilities in increasingly smaller form factors. For example, portable devices are able produce high resolution video data streams from either stored data or data received through either a wired or wireless data communications circuit. Portable electronic devices are increasingly able to process or create large volumes of data that are able to be provided to external data systems, such as storage or display devices. Such increasing processing power often is accompanied by increasing electrical power consumption. Further, many portable electronic devices include a portable power pack that comprises a power storage element, such as a battery, that is recharged or replenished with power from time to time. Several connectors are generally required to provide high speed data communications and electrical power to an electronic device. Adding additional connectors to an electronic device introduces costs, product reliability concerns, and susceptibilities to inadvertent disconnections during use.

Presently available connectors for data communications circuits often utilize electronic data communications circuits that communicate data by varying voltage levels and associated current flows. As communications speeds increase for an electronic data communications circuit, electromagnetic interference becomes a increasing problem. Electromagnetic problems include both emitted interference generated by the high speed electronic data circuit and data errors suffered by the electronic data communications circuit that are induced by surrounding electromagnetic signals. These problems become more pronounced in high speed electronic data communications circuit that operate over long distances, such as a circuit between two electronic devices connected through a multiple conductor cable that has connectors at each end.

Existing connectors complying with promulgated standards have become pervasive. For example, connectors, cables and supporting hardware and software compliant with the USB 2.0 standard are readily available. The USB 2.0 standard allows for both data communication and power transfer in a miniaturized connector adapted for use with small portable devices such as cell phones for both transferring data and recharging power supplies. However, as the processing power and data storage capabilities of devices increase, the desire for connectors able to provide for increased data bandwidth increases.

Therefore, present data communications circuit connectors provide for lower bandwidth communication using an established compact connector size, but limit the ability to communicate high speed data.

BRIEF DESCRIPTION OF THE DRAWINGS

The accompanying figures where like reference numerals refer to identical or functionally similar elements throughout the separate views, and which together with the detailed description below are incorporated in and form part of the specification, serve to further illustrate various embodiments and to explain various principles and advantages all in accordance with the present disclosure, in which.

DETAILED DESCRIPTION

Figure 1:
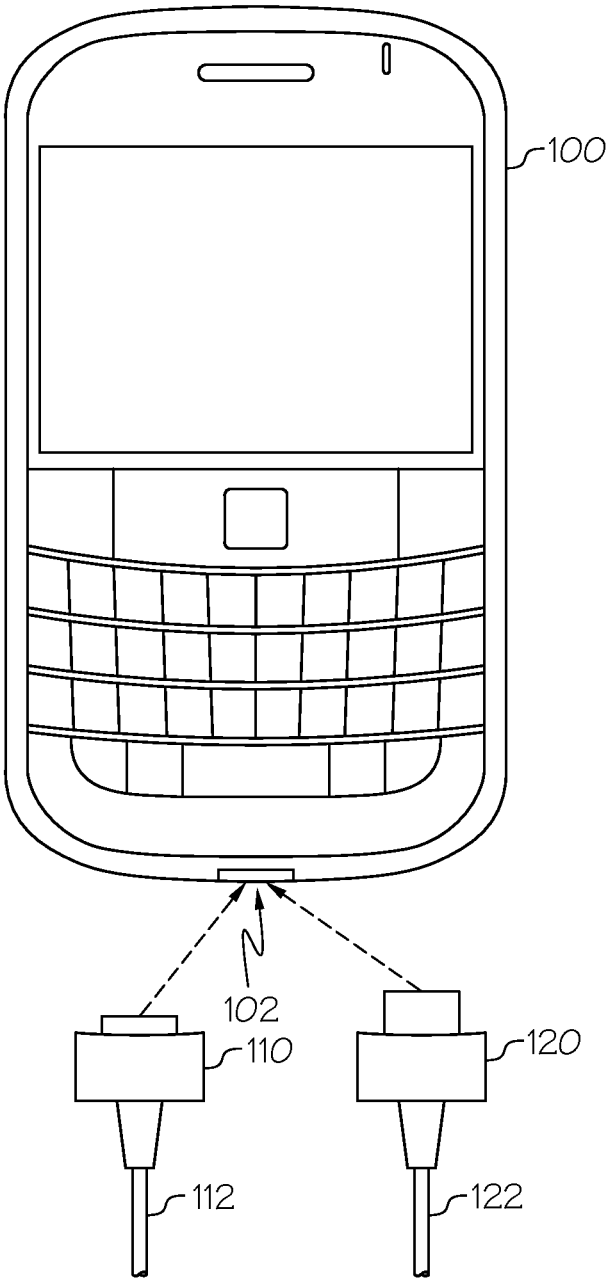
FIG. 1 illustrates a representative example of system incorporating a multiple bandwidth connector apparatus.

As required, detailed embodiments are disclosed herein; however, it is to be understood that the disclosed embodiments are merely examples and that the systems and methods described below can be embodied in various forms. Therefore, specific structural and functional details disclosed herein are not to be interpreted as limiting, but merely as a basis for the claims and as a representative basis for teaching one skilled in the art to variously employ the disclosed subject matter in virtually any appropriately detailed structure and function. Further, the terms and phrases used herein are not intended to be limiting, but rather, to provide an understandable description.

The terms "a" or "an", as used herein, are defined as one or more than one. The term plurality, as used herein, is defined as two or more than two. The term multiplicity, as used herein, is defined as three or more than three. The term pair, as used herein, is defined as two. The term another, as used herein, is defined as at least a second or more. The terms "including" and "having," as used herein, are defined as comprising (i.e., open language). The term "coupled," as used herein, is defined as "connected," although not necessarily directly, and not necessarily mechanically. The term "configured to" describes hardware, software or a combination of hardware and software that is adapted to, set up, arranged, built, composed, constructed, designed or that has any combination of these characteristics to carry out a given function. The term "adapted to" describes hardware, software or a combination of hardware and software that is capable of, able to accommodate, to make, or that is suitable to carry out a given function. In the following discussion, "handheld" is used to describe items, such as "handheld devices," that are sized, shaped, designed or otherwise configured to be carried and operated while being held in a human hand. The term "making" as used herein describes an act or process of forming, causing, doing or coming into being. The term "interference fit" as used herein includes the fastening between two parts which is achieved by a friction or interlocking interface after the parts are pushed together and include a press fit or a friction fit wherein after the two parts are fitted together, one part slightly occupies a space that was occupied by the other part before the fit.

In one example, a connector comprises a housing having a row of regularly spaced contact receiving channels and a multiplicity of contacts comprising an electrically conductive material and mounted in the contact receiving channels. Each contact has a blade arm, an attaching tail, and a mounting area between the blade arm and the attaching tail, each mounting area being similarly sized and having a top edge and a bottom edge for making an interference fit with the housing. The multiplicity of contacts include a first contact mounted in a first contact receiving channel, the first contact mounting area having a conductive center portion, and a second contact mounted in a second contact receiving channel adjacent to the first contact receiving channel, the second contact mounting area having a non-conductive center portion.

In another example, a connector comprises a housing having a row of regularly spaced contact receiving channels and a multiplicity of contacts comprising an electrically conductive material and mounted in the contact receiving channels. Each contact has a blade arm, an attaching tail, and a mounting area between the blade arm and the attaching tail, the mounting area having a top edge and a bottom edge for making an interference fit with the housing. The multiplicity of contacts include a multiplicity of high bandwidth contacts mounted in a multiplicity contact receiving channels, at least some of the multiplicity of high bandwidth contacts for transferring digital signals of up to a first data rate and having mounting areas having a non-conductive center portion, and a plurality of low bandwidth contacts mounted in a plurality of contact receiving channels adjacent to and interposed between the multiplicity of contact receiving channels, at least some of plurality of low bandwidth contacts for transferring digital signals of up to a second data rate lower than the first data rate and having mounting areas having a conductive center portion.

In another example, a connector comprises a housing having a row of regularly spaced contact receiving channels and a multiplicity of contacts comprising an electrically conductive material and mounted in the contact receiving channels. Each contact has a blade arm, an attaching tail, and a mounting area between the blade arm and the attaching tail, the mounting area having a top edge and a bottom edge for making an interference fit with the housing. The multiplicity of contacts include a first plurality of contacts mounted in a first plurality of contact receiving channels, each of the first plurality of contact mounting areas having a conductive center portion, and a second plurality of contacts mounted in a second plurality of contact receiving channels, each of the second plurality of contact mounting areas having a non-conductive center portion.

FIG. 1 illustrates a representative example of a system incorporating a multiple bandwidth connector apparatus. Device 100 is a portable or a handheld electronic apparatus and is shown as a cell phone having an opening 102 for a socket for receiving a miniaturized connector for communicating data and power. In other examples device 100 may be a pager, personal digital assistant, e-reader, telephone, VoIP phone, smart phone, super phone, tablet, convertible PC, laptop, gaming system, music players video player, radio, television or other such device. Connectors couple to device 100 for the communication of data and power via a cable. Opening 102 is able to receive either of at least two connectors. Connector 110 is a low bandwidth connector and connector 120 is a high bandwidth connector. In one example, the low bandwidth connector 110 complies with the Universal Serial Bus (USB) 2.0 standard promulgated by the USB Implements Forum (USB-IF). In this example, connector 110 is a micro USB 2.0 connector having five contacts, including VBUS, D−, D+, ID, and GND. VBUS and GND are capable of providing or transferring electrical power. D− and D+ communicate low bandwidth data, under 0.5 gigabits per second, in accordance with the USB 2.0 standard. The five contacts of the micro USB 2.0 connector include adjacent parallel blade contacts spaced 0.65 mm apart. Given the lower bandwidth USB 2.0 and the relatively adequate spacing between the blade contacts, issues of crosstalk and undesired electromagnetic coupling between the blade contacts have been readily resolved. Cable 112 includes a multiplicity of wires and is coupled to connector 110 on one end, and the other end is connectable to a device able to interface with device 100. In the example of a USB 2.0 connector, the other device may be a personal computer or a power charging output or other USB compatible device known to persons familiar with the art.

Opening 102 also accepts high bandwidth connector 120 having both low bandwidth blade contacts supporting a low bandwidth interface, such as USB 2.0, as well as high bandwidth blade contacts for high bandwidth communications. At least some of the high bandwidth blade contacts are interposed between the low bandwidth blade contacts. In one example, the high bandwidth blade contacts include four contacts forming two lanes of differential pair data paths supporting a DisplayPort protocol, as defined by the Video Electronics Standards Association (VESA). Each lane is capable of data rates between 1.5 and 5.5 gigabits per second. In another example, only one lane is used and the remaining blade contacts may be used for other signaling purposes, including an auxiliary channel. Relative to DisplayPort, USB 2.0 has a low bandwidth, lower than the high bandwidth of the DisplayPort protocol. The high bandwidth blade contacts have contact tips that connect to high bandwidth contact pads 212, 214, 216 and 218 on socket 200 that are located on a different surface parallel to, but in a different plane from, low bandwidth contacts pads (see FIG. 2). The low bandwidth contact pads are for connecting to contact tips of the low bandwidth blade contacts of either the low bandwidth connector or the high bandwidth connector. High bandwidth connector 120 has a cable 122 which includes a multiplicity of wires. The high bandwidth connector 120 is connectable to a corresponding device able to support either or both the signals of the low bandwidth blade contacts or the high bandwidth blade contacts. In one example, the other end of cable 122 is coupled to a device able to separate USB 2.0 signals from DisplayPort signals for processing by separate USB and DisplayPort processes. In other examples of a high bandwidth connector, additional high bandwidth blade contacts are added to facilitate additional DisplayPort lanes or other DisplayPort signals, or to facilitate other high bandwidth standards, such as USB 3.0 or HDMI, in addition to or in place of the DisplayPort standard. In one such example, a pair of USB 3.0 contact blades is added to either side of the blade contacts of the high bandwidth connector.

Since the high bandwidth blade contacts are interposed between the low bandwidth blade contacts, and the center-to-center spacing between the low bandwidth blade contacts is maintained to facilitate socket compatibility with both the low bandwidth connector and the high bandwidth connector, the pitch or center-to-center spacing between the blade contacts of the high bandwidth connector is half the spacing between the blade contacts of the low bandwidth connector. This decrease in pitch or center-to-center spacing increases the electromagnetic coupling between the contacts of the high bandwidth connector.

From one perspective, the blade contacts act as parallel plates of a capacitor. The determination of such capacitance is primarily the result of multiplying the overlapping conductive surface area of the contact by the permittivity of a region between the contacts and dividing by the distance between contacts. In this example the distance between the contacts is reduced by half due to contact center-to-center spacing, or pitch being reduced by half. Furthermore, the distance is further reduced by the thickness of the contact. Applying the above calculation results in more than a doubling of capacitance between the blades. If left alone, this increased capacitance could have detrimental effects on electromagnetic interference between the blades. The detrimental effects are compounded by the higher frequency data of the interposed blades, which has increased high bandwidth electrical energy that is more susceptible to degradation due to the increased coupling capacitance of the closer blades.

Experimental tests have established that these detrimental effects can be mitigated by placing a nonconductive portion or electromagnetic reduction aperture within the contacts transferring digital signals. In one example, the electromagnetic reduction aperture is a hole or opening or ring or other shape formed in the conductive material of the contact in such a way as to define an electromagnetic reduction aperture devoid of conductive material. The aperture reduces the effective overlapping area used in the capacitance calculation. The center portion void or aperture may be occupied by air, vacuum or another insulator or other non-conductive material may be inserted within the aperture. Experimental tests have shown that the added aperture allows for both high bandwidth communications and significantly closer placement of the blades. However, the aperture can increase the resistance of the contacts used for transferring power, since such contacts do not tend to couple electromagnetic interference it is advantageous to eliminate the electromagnetic reduction aperture from the power transfer contacts.

In another example, the low bandwidth contacts of the high bandwidth connector do not implement the non-conductive center portion aperture while providing for both the higher data rate and the significantly closer placement of the blades. This allows use of unmodified low bandwidth blade contacts in either the low bandwidth connector 110 or the high bandwidth connector 120, thereby saving the time and expense of redesigning a low bandwidth blade contact, as well as allowing for the reuse of the established robustness an existing the low bandwidth connector. Thus in this example, the high bandwidth connector has high bandwidth contacts with a non-conductive center portion aperture and low bandwidth contacts with a conductive center portion and no aperture. The low bandwidth blade contacts may also be usable in the low bandwidth connector or in the high bandwidth connector and combined with the high bandwidth blade connectors having an aperture and interposed between the low bandwidth blade connectors.

Figure 2:
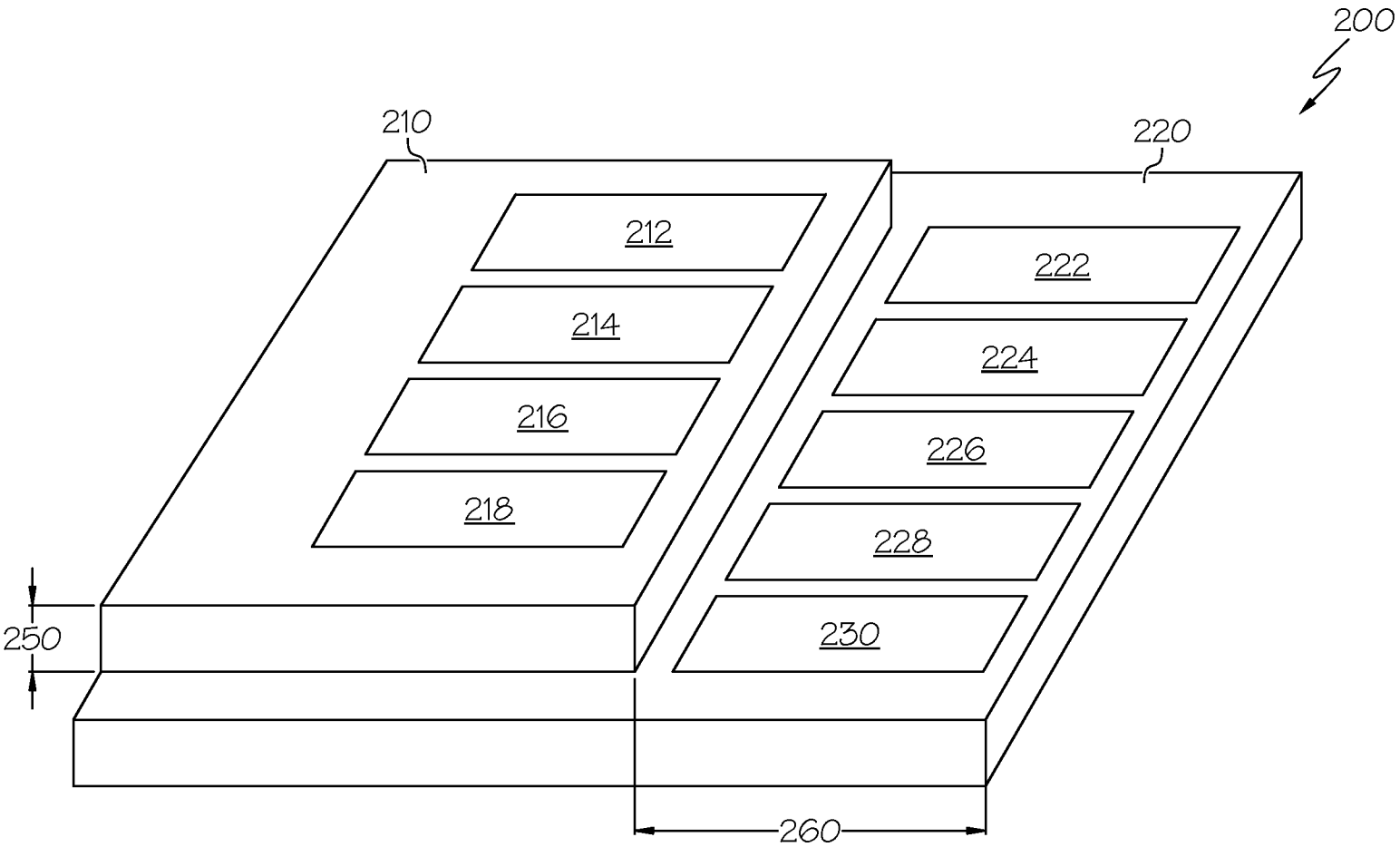
FIG. 2 illustrates a representative example of a socket for a multiple bandwidth connector apparatus.

FIG. 2 illustrates a representative example of a socket for a multiple bandwidth connector apparatus. Socket 200 has a multiple parallel surfaces with contact pads. The first surface 210 has a plurality of high bandwidth contact pads 212-218. In one example the high bandwidth contact pads facilitate connection of two lanes of differential pair data paths supporting a DisplayPort protocol, each lane capable of data rates between 1.5 and 5.5 gigabits per second. In another example, only one differential pair is used and the remaining contacts may be used of other signaling including auxiliary signaling. The second surface 220 has a multiplicity of low bandwidth contact pads 222-230. In one example the low bandwidth contact pads correspond to contacts pads for a micro USB 2.0 connector having five contacts, including VBUS, D−, D+, ID, and GND. The first surface 210 is parallel to the second surface 220 and is spaced apart from the second surface by a height distance 250, which in one example is 0.2 mm, and an offset distance 260, which in one example is 2.5 mm, thereby revealing both low bandwidth contacts and high bandwidth contacts for making contact with corresponding low bandwidth connector 110 and high bandwidth connector 120.

Figure 3:
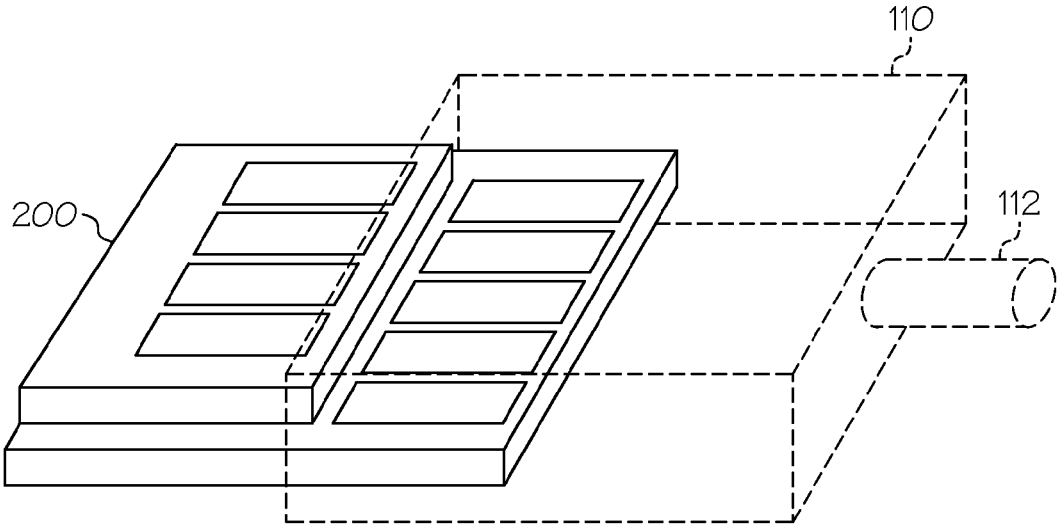
FIG. 3 illustrates a representative example of a socket for a multiple bandwidth connector apparatus connected to a low bandwidth connector.

FIG. 3 illustrates a representative example of a socket for a multiple bandwidth connector apparatus connected to a low bandwidth connector. Low bandwidth connector 110 is shown making connection with the low bandwidth contact pads of socket 200 and not the high bandwidth contact pads.

Figure 4:
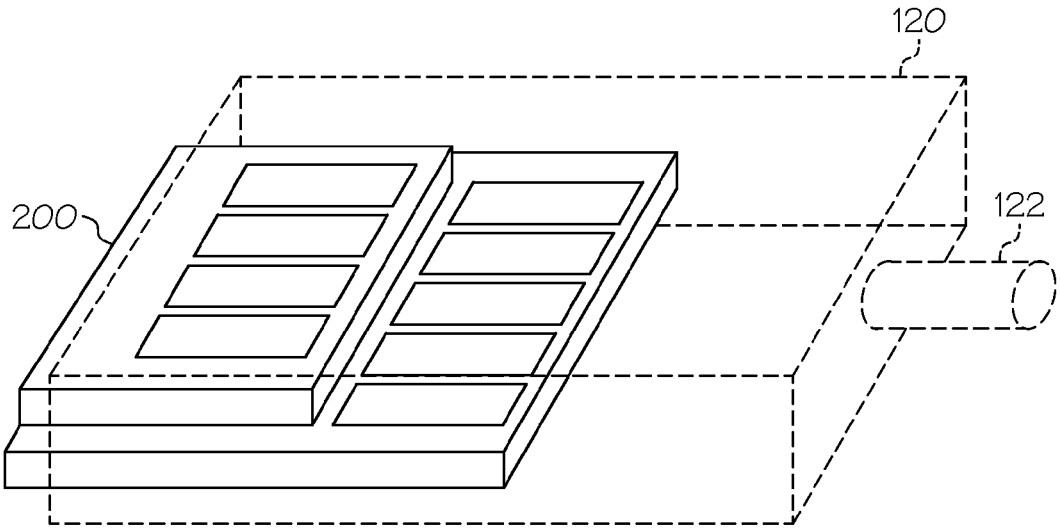
FIG. 4 illustrates a representative example of a socket for a multiple bandwidth connector apparatus connected to a high bandwidth connector.

FIG. 4 illustrates a representative example of a socket for a multiple bandwidth connector apparatus connected to a high bandwidth connector. High bandwidth connector 120 is shown making connection with the low bandwidth contact pads and the high bandwidth contact pads of socket 200.

Figure 5:
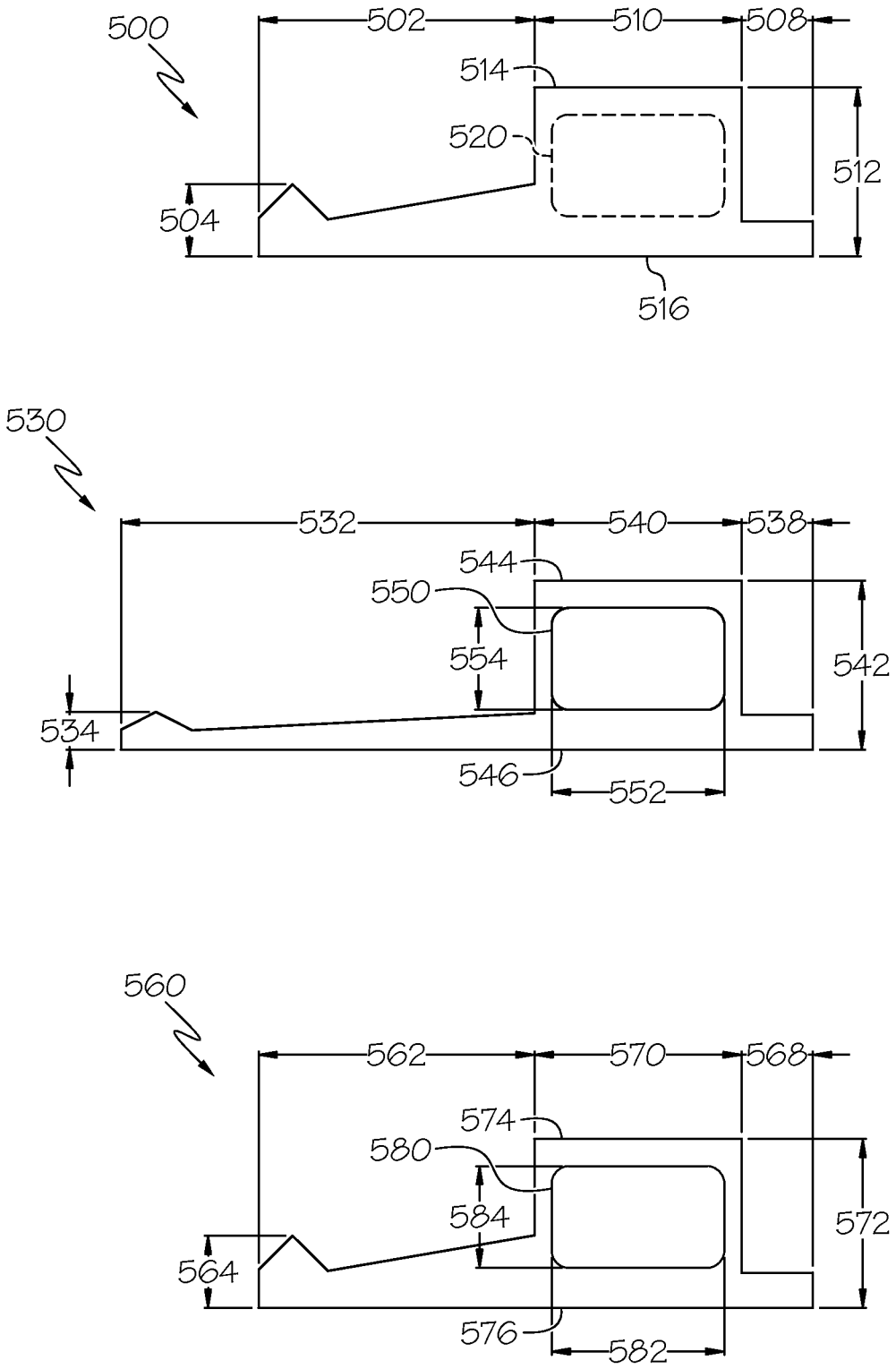
FIG. 5 illustrates a representative example of a various contacts of the disclosure.

FIG. 5 illustrates a representative example of various contacts of the disclosure. Power transfer contact 500, high bandwidth contact 530, and low bandwidth contact 560 in one example comprise cut to form sheet metal which may be formed by one or more of several processes known to persons familiar with the art. These processes include use of a pressing and forming tool, a laser cutting tool, and/or a milling cutting tool. The metal used in the contacts may be of any material know to be used for contacts including copper, iron, steel, carbon, aluminum, nickel, silver and/or gold and may or may not be plated. The contacts of FIG. 5 may be referred to using terms such as blade contacts, knife contacts, and edge contacts.

Contact 500 comprises electrically conductive material and has a blade arm having a length of 502, which in one example is 7.2 mm, and a point contact having a height 504, which in one example is 0.5 mm for contacting a contact pad of socket 200. Contact 500 further has an attaching tail having a length of 508, which in one example is 2.0 mm. Contact 500 further has a mounting area between the blade arm and the attaching tail, the mounting area has a length 510 and a height 512, which in one example the length is 5.3 mm and the height is 1.0 mm. In this example, the mounting area has an overall area of 5.3 $mm^2$. The mounting area also has a top edge 514 and a bottom edge 516 for making an interference fit with the connector housing. The top edge and/or the bottom edge may include one or more teeth, ridges or other perturbations for enhancing the interference fit. Contact 500 further has a conductive center portion 520 which may comprise the same conductive material as the rest of the contact. In another example, contact 500 has a total surface area of between 7 $mm^2$ and 8 $mm^2$ exclusive of the attaching tail area.

Contact 530 comprises electrically conductive material and has a blade arm having a length of 532, which in one example is 9.7 mm, which is longer than the blade arm of contact 500. Contact 530 also has a point contact having a height 534, which in one example is 0.3 mm for contacting a contact pad of socket 200. Contact 530 further has an attaching tail having a length of 538, which in one example is 2.0 mm. Contact 530 further has a mounting area between the blade arm and the attaching tail. The mounting area has a length 540 and a height 542, which in one example, the length is 5.3 mm and the height is 1.0 mm. Thus, the mounting area has an overall area of 5.3 $mm^2$. The mounting area also has a top edge 544 and a bottom edge 546 for making an interference fit with the connector housing. The top edge and/or the bottom edge may include one or more teeth, ridges or other perturbations for enhancing the interference fit. Contact 530 further has a non-conductive center portion 550 having a length 552 and a height 554, which in one example, the length is 2.8 mm and the height is 0.5 mm. While the center portion is shown as being substantially rectangular, in other examples, other shapes may be implemented. Other shapes include circles, ovals or rectangles with radiused corners. In an example of a rectangular non-conductive center portion, the non-conductive center portion occupies an area of 1.4 $mm^2$, or 24% of the contact area. In one example, the non-conductive portion 550 is formed by providing an opening in the contact thereby allowing atmospheric air to form the non-conductive portion. In other examples, other non-conductive materials may be incorporated into non-conductive portion 550. In another example, contact 530 has a total surface area of between 8.5 $mm^2$ and 9.5 $mm^2$ exclusive of the attaching tail area and inclusive of area center portion 550.

Contact 560 comprises electrically conductive material and has a blade arm having a length of 562, which in one example is 7.1 mm, which is shorter than the blade arm of contact 500. Contact 560 has a point contact having a height 564, which in one example is 0.5 mm for contacting a contact pad of socket 200. Contact 560 further has an attaching tail having a length of 568, which in one example is 2.0 mm. Contact 560 further has a mounting area between the blade arm and the attaching tail. The mounting area has a length 570 and a height 572, which in one example the length is 5.3 mm and the height is 1.0 mm, and has an overall area of 5.3 $mm^2$. The mounting area also has a top edge 574 and a bottom edge 576 for making an interference fit with the connector housing. The top edge and/or the bottom edge may include one or more teeth, ridges or other perturbations for enhancing the interference fit. Contact 560 further has a non-conductive center portion 580 having a length 582 and a height 584, which in one example, the length is 2.8 mm and the height is 0.5 mm. While the center portion is shown as being substantially rectangular, in other examples, other shapes may be implemented. Other shapes include circles, ovals or rectangles with corners having a radius cut. In an example of a rectangular non-conductive center portion, the non-conductive center portion occupies an area of 1.4 $mm^2$, or 24% of the contact area. In one example, the non-conductive portion 550 is formed by providing an opening in the contact thereby allowing atmospheric air to form the non-conductive portion. In other examples, other non-conductive materials can be incorporated into non-conductive portion 580. In another example, contact 560 has a total surface area of between 7 $mm^2$ and 8 $mm^2$ exclusive of the attaching tail area and inclusive of area center portion 580.

Contacts 530 and 560 in one example have mounting areas of 5.3 $mm^2$ and center portions of 1.4 $mm^2$. The top and or bottom edges may further include teeth which can enlarge the mounting area up to 0.3 $mm^2$, thereby providing for a mounting area ranging from 5.3 $mm^2$ to 5.6 $mm^2$. Furthermore, the rectangular center portion may include corners with a 0.25 $mm^2$ radius, thereby reducing the center portion by 0.1 $mm^2$ and providing a center portion ranging from 1.3 $mm^2$ to 1.4 $mm^2$. Thus with a 5.3 $mm^2$ mounting area and a 1.4 $mm^2$ center portion, ranging to a 5.6 $mm^2$ mounting area to a 1.3 $mm^2$ center portion, the center portion ranges from 23% to 25% of the mounting area.

Increasing the area of the center portion decreases the electromagnetic coupling of the high bandwidth blade contact, but also decreases a maximum spring load of the blade arm. Experimentation and tests have established that the above referenced dimensions provide both adequate spring load of the blade arm as well as adequate electromagnetic decoupling of the contacts. This provides for robust repetitive connector insertions and removals while securely making contact with corresponding socket pads. In other examples, the area of the center portion 550 or 580 may extend beyond the mounting area 540 or 570 and into the blade arm 532 or 562, or into the attaching tail 538 or 568 while remaining within the scope of this description.

The contacts also includes attaching tails for attaching a cable having a cable 122 having plurality of wires to the contacts of the connector. The attachment of a wire to a contact may be via solder, press fit or other approach known to those familiar with the art.

Figure 6:
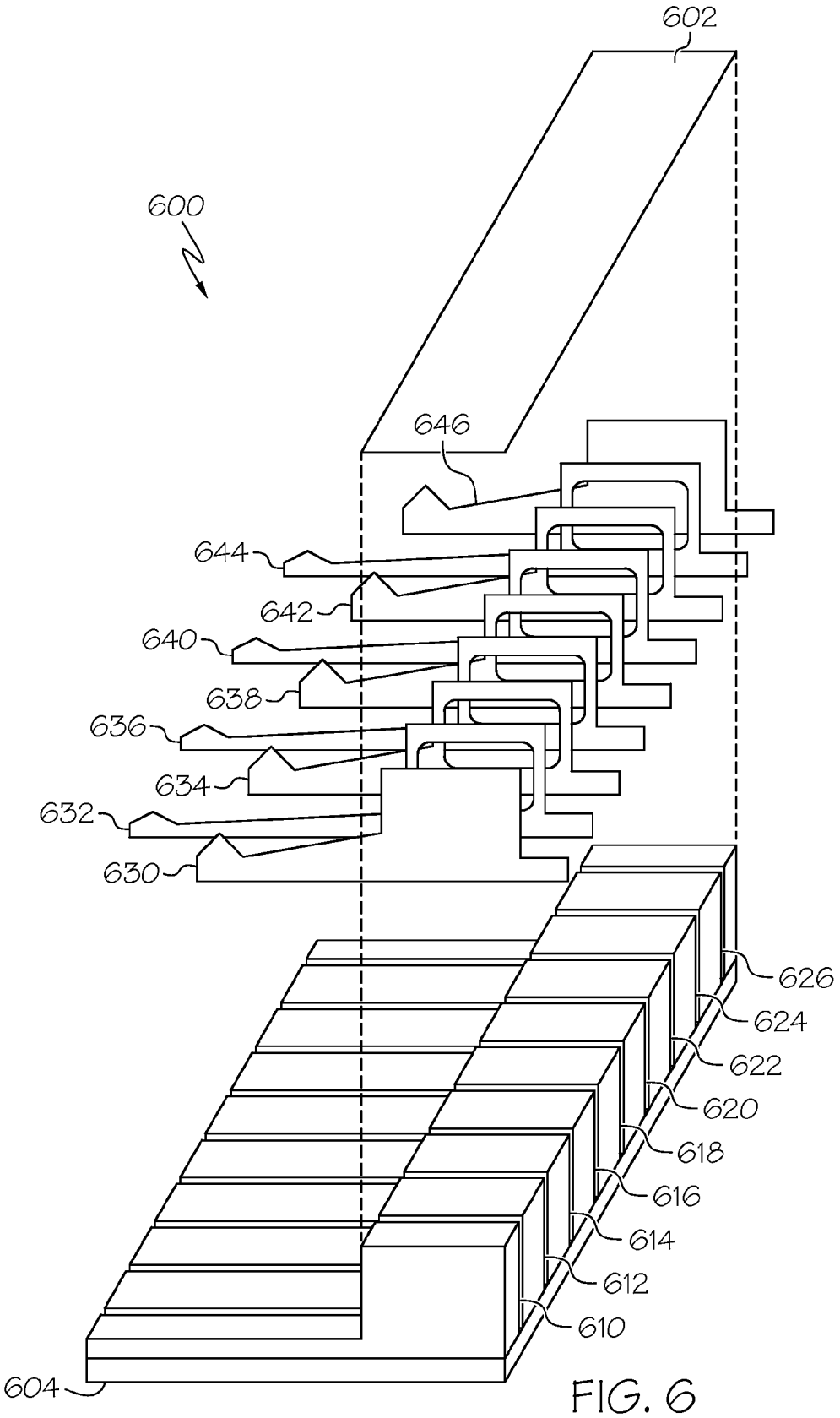
FIG. 6 illustrates a first representative example of an exploded view of a high digital bandwidth connection apparatus.

FIG. 6 illustrates a first representative example of an exploded view of a high digital bandwidth connection apparatus. Connector 600 includes a cap 602 for attaching to a housing 604 having a row of regularly spaced contact receiving channels 610-626. When assembled, the cap 602 and housing 604 provide for an interference fit of the contacts within the connector. In another example, the cap 602 and housing 604 may be a single unit cast at the time of manufacturing. In one example, the contact receiving channels are spaced with a center-to-center spacing of about 0.325 mm.

The connector 600 also includes a multiplicity of contacts 630-646, each contact having a blade arm, an attaching tail, and a mounting area between the blade arm and the attaching tail. Each mounting area is similarly sized and has a top edge and a bottom edge for making an interference fit with the housing. The first contact 630 is mounted in the first contact receiving channel 610 and corresponds to contact 500 having a conductive center portion and having a blade arm with a first length. The second contact 632 is mounted in the second contact receiving channel 612 which is adjacent to the first contact receiving channel 610. The second contact corresponds to contact 530 and has a non-conductive center portion and has a blade arm length longer than the first length. The third contact 634 is mounted in the third contact receiving channel 614 which is adjacent to the second contact receiving channel 612. The third contact corresponds to contact 560 and has a non-conductive center portion and has a blade arm length shorter than the first length. The fourth contact 636 is mounted in the fourth contact receiving channel 616 which is adjacent to the third contact receiving channel 614. The fourth contact corresponds to contact 530 and has a non-conductive center portion and has a blade arm length longer than the first length. The fifth contact 638 is mounted in the fifth contact receiving channel 618 which is adjacent to the fourth contact receiving channel 616. The fifth contact corresponds to contact 560 and has a non-conductive center portion and has a blade arm length shorter than the first length. The sixth contact 640 is mounted in the sixth contact receiving channel 620 which is adjacent to the fifth contact receiving channel 618. The sixth contact corresponds to contact 530 and has a non-conductive center portion and has a blade arm length longer than the first length. The seventh contact 642 is mounted in the seventh contact receiving channel 622 which is adjacent to the sixth contact receiving channel 620. The seventh contact corresponds to contact 560 and has a non-conductive center portion and has a blade arm length shorter than the first length. The eighth contact 644 is mounted in the eighth contact receiving channel 624 which is adjacent to the seventh contact receiving channel 622. The eighth contact corresponds to contact 530 and has a non-conductive center portion and has a blade arm length longer than the first length. The ninth contact 646 is mounted in the ninth contact receiving channel 626 which is adjacent to the eighth contact receiving channel 624. The ninth contact corresponds to contact 500 and has a conductive center portion and has a blade arm length equivalent to the first length.

Using the example dimensions of the contacts of FIG. 5, FIG. 6 shows an example of a connector wherein the row of contact receiving channels are spaced with a center-to-center spacing of 0.325 mm, the mounting area of the contacts range between 5.3 $mm^2$ and 5.6 $mm^2$, and the non-conductive center portions range between 23% and 25% of the mounting area. Test results have demonstrated that given a connector with these dimensions, a reduction in the symbol error rate of data signals transmitted through the connector is realized, while maintaining a robust blade arm spring rate. Furthermore, the non-conductive center portion reduces the weight and material cost of the connector.

In the connector of FIG. 6, the third, fifth, and seventh contacts 634, 638, and 642 facilitate transfer of the USB 2.0 protocol digital signals D−, D+, and ID. Furthermore, contacts 630 and 646 have conductive center portions and transmit electrical power with reduced resistance and include VBUS and GND of the USB 2.0 protocol. Also at least some of the second, fourth, sixth, and eighth contacts 632, 636, 640, and 644 facilitate transfer of a DisplayPort protocol digital signals, or DisplayPort digital signaling protocol, including at least one lane of high speed digital signals and the auxiliary channel.

The connector of FIG. 6 also shows a connector having a multiplicity of contacts 630-646, where first plurality of contacts 630 and 646 are mounted in a first plurality of contact receiving channels 610 and 626 where each of the first plurality of contact mounting areas have a conductive center portion 520. Also, a second plurality of contacts 632-644 are mounted in a second plurality of contact receiving channels 612-624, each of the second plurality of contact mounting areas having a non-conductive center portion 550, 580. Thus, contacts with and without conductive center areas are used in the connector, thereby taking advantage of the properties or each contact type. Contacts with conductive centers providing improved power transfer through the connector and contacts non-conductive centers providing improved digital signal bandwidth and reduced symbol error rates.

FIG. 6 also shows that a first contact blade arm 630 having a first length 502. Furthermore, second, fourth, sixth and eighth contact blade arms 632, 636, 640, and 644 have lengths 532 longer than the first length 502, and fifth and seventh contact blade arms 734, 738, and 742 have lengths 562 shorter than the first length 502. Finally, the ninth contact blade arm 746 has a length 502 equivalent to the first length 502. The first and ninth contacts, 730 and 746, facilitate transfer of electrical power and the second, third, fourth, fifth, sixth, seventh and eighth contacts, 732-744, facilitate transfer of digital signals. The third, fifth, and seventh contacts 734, 738, and 742, facilitate the transfer of USB 2.0 protocol digital signals and at least some of the second, fourth, sixth, and eighth contacts 732, 736, 740, and 744, facilitate transfer of DisplayPort protocol digital signals. This configuration allows for the high bandwidth connector of the description to be used in combination with the low bandwidth connector 110 with a common socket 102.

Figure 7:
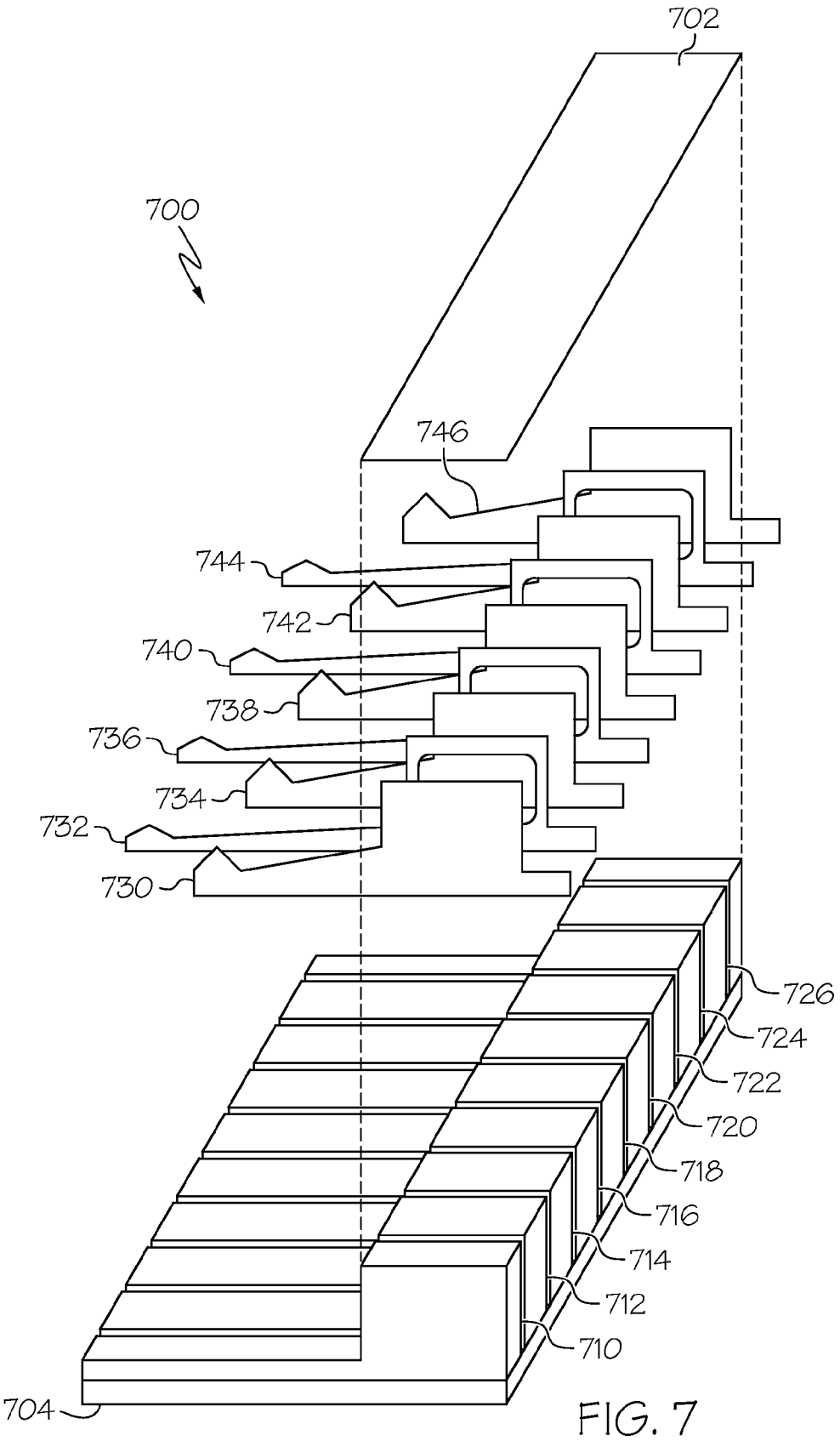
FIG. 7 illustrates a second representative example of an exploded view of a high digital bandwidth connection apparatus.

FIG. 7 illustrates a second representative example of an exploded view of a high digital bandwidth connection apparatus. Connector 700 includes a cap 702 for attaching to a housing 704 having a row of regularly spaced contact receiving channels 710-726. When assembled, the cap 702 and housing 704 provide for an interference fit of the contacts within the connector. In another example, the cap 702 and housing 704 may be a single unit cast at the time of manufacturing. In one example, the contact receiving channels are spaced with a center-to-center spacing of about 0.325 mm.

The connector 700 also includes a multiplicity of contacts 730-746, each contact having a blade arm, an attaching tail, and a mounting area between the blade arm and the attaching tail. Each mounting area is similarly sized and has a top edge and a bottom edge for making an interference fit with the housing. The first contact 730 is mounted in the first contact receiving channel 710 and corresponds to contact 500 having a conductive center portion and having a blade arm with a first length. The second contact 732 is mounted in the second contact receiving channel 712 which is adjacent to the first contact receiving channel 710. The second contact corresponds to contact 530 and has a non-conductive center portion and has a blade arm length longer than the first length. The third contact 734 is mounted in the third contact receiving channel 714 which is adjacent to the second contact receiving channel 712. The third contact corresponds to contact 560 but has the conductive center portion of 520 of contact 500, and has a blade arm length shorter than the first length. The fourth contact 736 is mounted in the fourth contact receiving channel 716 which is adjacent to the third contact receiving channel 714. The fourth contact corresponds to contact 530 and has a non-conductive center portion and has a blade arm length longer than the first length. The fifth contact 738 is mounted in the fifth contact receiving channel 718 which is adjacent to the fourth contact receiving channel 716. The fifth contact corresponds to contact 560 but has the conductive center portion of 520 of contact 500, and has a blade arm length shorter than the first length. The sixth contact 740 is mounted in the sixth contact receiving channel 720 which is adjacent to the fifth contact receiving channel 718. The sixth contact corresponds to contact 530 and has a non-conductive center portion and has a blade arm length longer than the first length. The seventh contact 742 is mounted in the seventh contact receiving channel 722 which is adjacent to the sixth contact receiving channel 720. The seventh contact corresponds to contact 560 but has the conductive center portion of 520 of contact 500, and has a blade arm length shorter than the first length. The eighth contact 744 is mounted in the eighth contact receiving channel 724 which is adjacent to the seventh contact receiving channel 722. The eighth contact corresponds to contact 530 and has a non-conductive center portion and has a blade arm length longer than the first length. The ninth contact 746 is mounted in the ninth contact receiving channel 726 which is adjacent to the eighth contact receiving channel 724. The ninth contact corresponds to contact 500 and has a conductive center portion and has a blade arm length substantially equivalent to the first length.

FIG. 7 shows a multiplicity of high bandwidth contacts 732, 736, 740, and 744 mounted in a multiplicity contact receiving channels 712, 716, 720, and 724, at least some of the multiplicity of high bandwidth contacts for transferring digital signals of up to a first data rate and having mounting areas having a non-conductive center portion. The first data rate in this example corresponds to at least one lane of the DisplayPort protocol which is transferred on at least some of the high bandwidth contacts.

FIG. 7 also shows a plurality of low bandwidth contacts 734, 738, and 742 mounted in a plurality of contact receiving channels 714, 718, and 722 adjacent to and interposed between the multiplicity of contact receiving channels 712, 716, 720, and 724. At least some of plurality of low bandwidth contacts for transferring digital signals of up to a second data rate lower than the first data rate and having mounting areas having a conductive center portion. The second data rate in this example corresponds to the data rate of the USB 2.0 protocol, which is lower than the data rate of the DisplayPort protocol. The digital signals which are transferred on at least some of the low bandwidth contacts include D+, D− of the USB 2.0 protocol.

FIG. 7 also shows a pair of power transfer contacts 730 and 746 mounted in a pair of contact receiving channels 710 and 726, each of the pair of power transfer contact mounting areas having a conductive center portion. Furthermore, the multiplicity of high bandwidth contacts and the plurality of low bandwidth contacts 732 and 744 are interposed between the pair of power transfer contacts 730 and 746, and each of the pair of power transfer contacts is adjacent to one of the multiplicity of high bandwidth contacts. Power transfer contact 730 is adjacent to high bandwidth contact 732, and power transfer contact 746 is adjacent to high bandwidth contact 744.

FIG. 7 also shows that the pair of power transfer contacts includes two contacts 730 and 746, each having a blade arm of a first length 502. Furthermore, the multiplicity of high bandwidth contacts include four contacts 732, 736, 740 and 744, each having a blade arm of a second length 532 greater than the first length 502. And, the plurality of low bandwidth contacts includes three contacts 734, 738, and 742, each having a blade arm of a third length 562 shorter than the first length 502. This configuration allows for the high bandwidth connector of the description to be used in combination with the low bandwidth connector 110 with a common socket 102.

As previously discussed, the contacts of a USB 2.0 connector do not require a non-conductive center portion to transfer data and electrical power. The connector of FIG. 7 allows for an electromagnetic reduction aperture in the high bandwidth DisplayPort contacts 632, 636, 640, and 644, while providing for the use of pre-existing USB 2.0 contacts for contacts 630, 634, 638, 642, and 646. This provides an advantage of reducing electromagnetic interference of the high bandwidth signals of the high bandwidth connector, the interference due to both the contacts of connector being spaced closer together than the low bandwidth USB 2.0 connector and the higher data rate signals of the high bandwidth contacts, while continuing to maintain the use of pre-existing contacts for low bandwidth connectors.

Using the example dimensions of the contacts of FIG. 5, FIG. 7 shows an example of a connector wherein the contact receiving channels in the row of contact receiving channels are spaced with a center-to-center spacing of 0.325 mm, the mounting area of the contacts range between 5.3 $mm^2$ and 5.6 $mm^2$, and the non-conductive center portions between 23% and 25% of the mounting area. In addition to the electromagnetic interference reduction, the non-conductive center portion reduces the weight and material cost of the connector.

FIG. 7 also shows a first contact 730 mounted in a first contact receiving channel 710, the first contact mounting area having a conductive center portion. Also, a second contact 732 mounted in a second contact receiving channel 712 adjacent to the first contact receiving channel 710, the second contact mounting area having a non-conductive center portion, and a third contact 734 mounted in a third contact receiving channel 714 adjacent to the second contact receiving channel 712, the third contact mounting area having a conductive center portion. Thus, a high bandwidth contact 732 having a non-conductive center portion is surrounded by contacts 730 and 734 having conductive center portions. Nevertheless, the non-conductive center portion of the high bandwidth contact reduces the overlapping area of the parallel plates of the capacitor formed by the connector and thus reduces the electromagnetic coupling between the adjacent contacts 730 and 734 without requiring the adjacent contacts to have non-conductive center portions. This allows re-use of existing contacts, provides for additional spring arm strength of the contacts, and improves the ability of the contact to transfer power.

FIG. 7 shows contacts with and without conductive centers areas are used in the connector, thereby taking advantage of the properties or each contact type. Contacts with conductive centers provide improved power transfer through the connector and transmission of low bandwidth digital signals and contacts non-conductive centers providing improved digital signal bandwidth and reduced symbol error rates and reduce crosstalk for high bandwidth digital signals.

Figure 8:
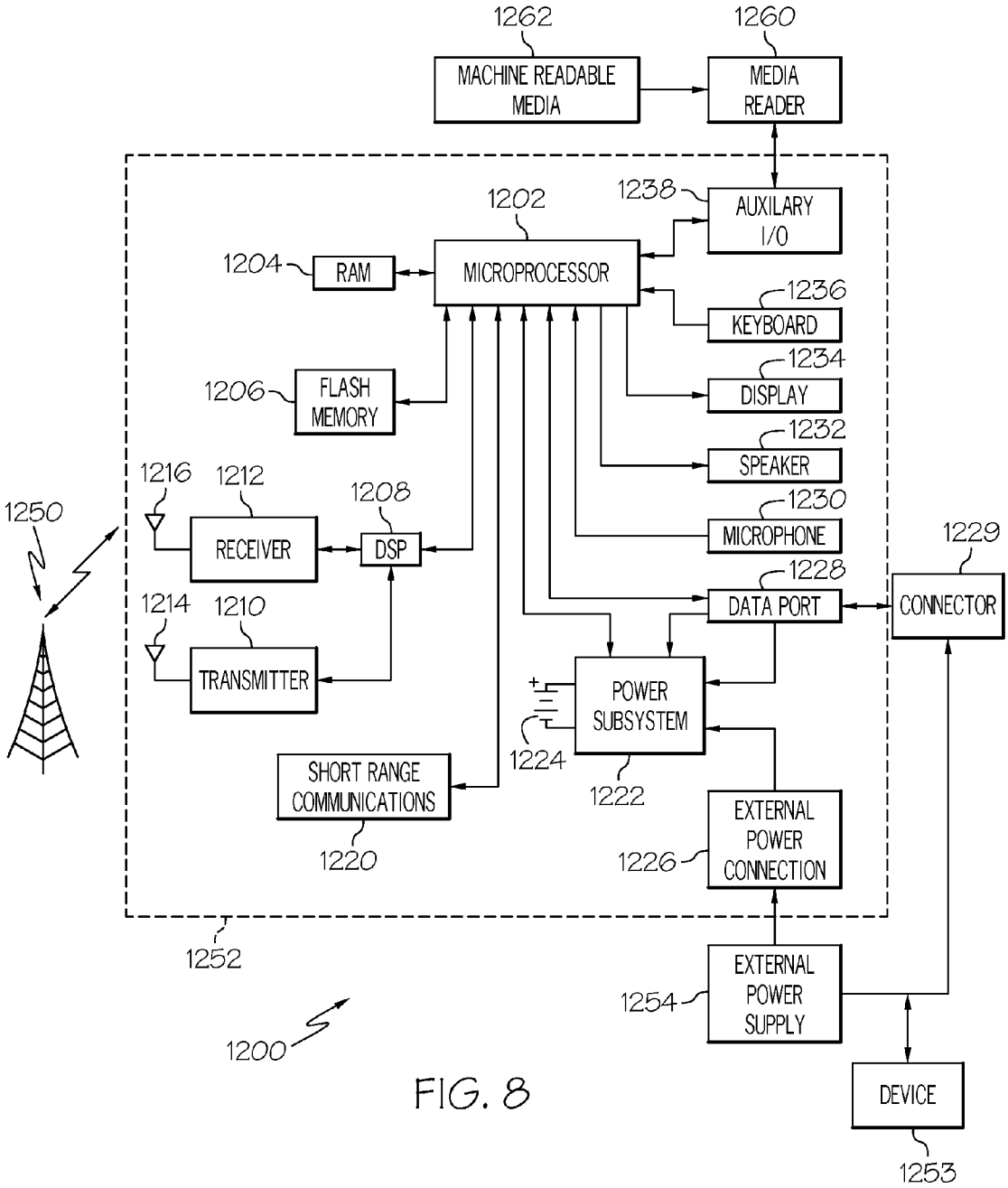
FIG. 8 illustrates a representative example of a block diagram of an electronic device and associated components that is able to include the above described systems.

FIG. 8 illustrates a representative example of a block diagram of an electronic device and associated components that is able to include the above described systems. FIG. 8 shows a block diagram of an electronic device and associated components 1200 in which the systems and methods disclosed herein may be implemented. In this example, an electronic device 1252 is a wireless two-way communication device with voice and data communication capabilities. Such electronic devices communicate with a wireless voice or data network 1250 using a suitable wireless communications protocol. Wireless voice communications are performed using either an analog or digital wireless communication channel. Data communications allow the electronic device 1252 to communicate with other computer systems via the Internet. Examples of electronic devices that are able to incorporate the above described systems and methods include, for example, a data messaging device, a two-way pager, a cellular telephone with data messaging capabilities, a wireless Internet appliance or a data communication device that may or may not include telephony capabilities.

The illustrated electronic device 1252 is an example electronic device that includes two-way wireless communications functions. Such electronic devices incorporate communication subsystem elements such as a wireless transmitter 1210, a wireless receiver 1212, and associated components such as one or more antenna elements 1214 and 1216. A digital signal processor (DSP) 1208 performs processing to extract data from received wireless signals and to generate signals to be transmitted. The particular design of the communication subsystem is dependent upon the communication network and associated wireless communications protocols with which the device is intended to operate.

The electronic device 1252 includes a microprocessor 1202, which may be, hut not be, the same processor as processor 156 discussed above, that controls the overall operation of the electronic device 1252. The microprocessor 1202 interacts with the above described communications subsystem elements and also interacts with other device subsystems such as flash memory 1206, random access memory (RAM) 1204, auxiliary input/output (I/O) device 1238, data port 1228, display 1234, keyboard 1236, speaker 1232, microphone 1230, a short-range communications subsystem 1220, a power subsystem 1222, and any other device subsystems.

One or more power storage or supply elements, such as a battery 1224, are connected to a power subsystem 1222 to provide power to the circuits of the electronic device 1252. The power subsystem 1222 includes power distribution circuitry for providing power to the electronic device 1252 and also contains battery charging circuitry to manage recharging the battery 1224 (or circuitry to replenish power to another power storage element). The power subsystem 1222 receives electrical power from external power supply 1254. The power subsystem 1222 is able to be connected to the external power supply 1254 through a dedicated external power connector (not shown) or through power connections within the data port 1228, such as are formed by the magnets of the plug connector 106 and receptacle connector 104 discussed above. The power subsystem 1222 includes a battery monitoring circuit that is operable to provide a status of one or more battery status indicators, such as remaining capacity, temperature, voltage, electrical current consumption, and the like, to various components of the electronic device 1252.

The data port 1228 of one example is a receptacle connector or socket 200 connected to connector 1229 corresponding to above connectors 110 or 120, as described above. The data port 1228 is able to support data communications between the electronic device 1252 and other devices 1253 through various modes of data communications, such as low speed and/or high speed data transfers. Data port 1228 is able to support communications with, for example, an external computer, video device, mass storage device or other device. In some examples, the data port 1228 is able to include electrical power connections to provide externally provided electrical power to the electronic device 1252, deliver electrical power from the electronic device 1252 to other externally connected devices, or both. Data port 1228 of, for example, an electronic accessory is able to provide power to an electronic circuit, such as microprocessor 1202, and support exchanging data between the microprocessor 1202 and a remote electronic device that is connected through the data port 1228.

Data communication through data port 1228 enables a user to set preferences through the external device or through a software application and extends the capabilities of the device by enabling information or software exchange through direct connections between the electronic device 1252 and external data sources rather than via a wireless data communication network. In addition to data communication, the data port 1228 provides power to the power subsystem 1222 to charge the battery 1224 or to supply power to the electronic circuits, such as microprocessor 1202, of the electronic device 1252.

Operating system software used by the microprocessor 1202 is stored in flash memory 1206. Further examples are able to use a battery backed-up RAM or other non-volatile storage data elements to store operating systems, other executable programs, or both. The operating system software, device application software, or parts thereof, are able to be temporarily loaded into volatile data storage such as RAM 1204. Data received via wireless communication signals or through wired communications are also able to be stored to RAM 1204.

The microprocessor 1202, in addition to its operating system functions, is able to execute software applications on the electronic device 1252. A set of applications that control basic device operations, including at least data and voice communication applications, is able to be installed on the electronic device 1252 during manufacture. Examples of applications that are able to be loaded onto the device may be a personal information manager (PIM) application having the ability to organize and manage data items relating to the device user, such as, but not limited to, e-mail, calendar events, voice mails, appointments, and task items.

Further applications may also be loaded onto the electronic device 1252 through, for example, the wireless network 1250, an auxiliary I/O device 1238, Data port 1228, short-range communications subsystem 1220, or any combination of these interfaces. Such applications are then able to be installed by a user in the RAM 1204 or a non-volatile store for execution by the microprocessor 1202.

In a data communication mode, a received signal such as a text message or web page download is processed by the communication subsystem, including wireless receiver 1212 and wireless transmitter 1210, and communicated data is provided the microprocessor 1202, which is able to further process the received data for output to the display 1234, or alternatively, to an auxiliary I/O device 1238 or the Data port 1228. A user of the electronic device 1252 may also compose data items, such as e-mail messages, using the keyboard 1236, which is able to include a complete alphanumeric keyboard or a telephone-type keypad, in conjunction with the display 1234 and possibly an auxiliary I/O device 1238. Such composed items are then able to be transmitted over a communication network through the communication subsystem.

For voice communications, overall operation of the electronic device 1252 is substantially similar, except that received signals are generally provided to a speaker 1232 and signals for transmission are generally produced by a microphone 1230. Alternative voice or audio 110 subsystems, such as a voice message recording subsystem, may also be implemented on the electronic device 1252. Although voice or audio signal output is generally accomplished primarily through the speaker 1232, the display 1234 may also be used to provide an indication of the identity of a calling party, the duration of a voice call, or other voice call related information, for example.

Depending on conditions or statuses of the electronic device 1252, one or more particular functions associated with a subsystem circuit may be disabled, or an entire subsystem circuit may be disabled. For example, if the battery temperature is low, then voice functions may be disabled, but data communications, such as e-mail, may still be enabled over the communication subsystem.

A short-range communications subsystem 1220 provides for data communication between the electronic device 1252 and different systems or devices, which need not necessarily be similar devices. For example, the short-range communications subsystem 1220 includes an infrared device and associated circuits and components or a Radio Frequency based communication module such as one supporting Bluetooth® communications, to provide for communication with similarly-enabled systems and devices, including the data file transfer communications described above.

A media reader 1260 is able to be connected to an auxiliary I/O device 1238 to allow, for example, loading computer readable program code of a computer program product into the electronic device 1252 for storage into flash memory 1206. One example of a media reader 1260 is an optical drive such as a CD/DVD drive, which may be used to store data to and read data from a computer readable medium or storage product such as computer readable storage media 1262. Examples of suitable computer readable storage media include optical storage media such as a CD or DVD, magnetic media, or any other suitable data storage device. Media reader 1260 is alternatively able to be connected to the electronic device through the Data port 1228 or computer readable program code is alternatively able to be provided to the electronic device 1252 through the wireless network 1250.

Information Processing System

Elements of the present disclosure can be realized in hardware, software, or a combination of hardware and software. A system can be realized in a centralized fashion in one computer system or in a distributed fashion where different elements are spread across several interconnected computer systems. Any kind of computer system—or other apparatus adapted for carrying out the methods described herein—is suitable. A combination of hardware and software could be a general purpose computer system with a computer program that, when being loaded and executed, controls the computer system such that it carries out the methods described herein.

Elements of the present disclosure can also be embedded in a computer program product, which comprises all the features enabling the implementation of the methods described herein, and which—when loaded in a computer system—is able to carry out these methods. Computer program in the present context means any expression, in any language, code or notation, of a set of instructions intended to cause a system having an information processing capability to perform a particular function either directly or after either or both of the following a) conversion to another language, code or, notation; and b) reproduction in a different material form.

Each computer system may include, inter alia, one or more computers and at least a computer readable medium allowing a computer to read data, instructions, messages or message packets, and other computer readable information from the computer readable medium. The computer readable medium may include computer readable storage medium embodying non-volatile memory, such as read-only memory (ROM), flash memory, disk drive memory, CD-ROM, and other permanent storage. Additionally, a computer medium may include volatile storage such as RAM, buffers, cache memory, and network circuits. Furthermore, the computer readable medium may comprise computer readable information in a transitory state medium such as a network link and/or a network interface, including a wired network or a wireless network that allow a computer to read such computer readable information.

Non-Limiting Examples

Although specific embodiments of the subject matter have been disclosed, those having ordinary skill in the art will understand that changes can be made to the specific embodiments without departing from the spirit and scope of the disclosed subject matter. For example, dimensions set forth herein may be modified while remaining with the scope of the description, and the dimensions may vary from part to part due to manufacturing tolerances while remaining within the scope of the description. The scope of the disclosure is not to be restricted, therefore, to the specific embodiments, and it is intended that the appended claims cover any and all such applications, modifications, and embodiments within the scope of the present disclosure.

What is claimed is:

1. An electrical connector comprising:

a housing having a row of regularly spaced contact receiving channels; and a multiplicity of contacts comprising an electrically conductive material and mounted in the contact receiving channels, each contact having a blade arm, an attaching tail, and a mounting area between the blade arm and the attaching tail, each mounting area being similarly sized and having a top edge and a bottom edge for making an interference fit with the housing, the multiplicity of contacts including a first contact mounted in a first contact receiving channel, the first contact mounting area consisting entirely of the electrically conductive material without having a non-conductive center portion in a center of the first contact mounting area, and a second contact mounted in a second contact receiving channel adjacent to the first contact receiving channel, the second contact mounting area having a non-conductive center portion.

2. The electrical connector according to claim 1 wherein the non-conductive center portion of the second contact is devoid of material.

3. The electrical connector according to claim 2 wherein the first contact facilitates transfer of electrical power and the second contact facilitates transfer of digital signals.

4. The electrical connector according to claim 1 wherein the contact receiving channels are regularly spaced with a center-to-center spacing of 0.325 mm, the mounting area of the first and second contacts ranges between 5.3 $mm^2$ and 5.6 $mm^2$, and the non-conductive center portion of the second contact occupies between 23% and 25% of the mounting area.

5. The electrical connector according to claim 1 wherein the multiplicity of contacts further includes a third contact mounted in a third contact receiving channel adjacent to the second contact receiving channel, the third contact mounting area having a non-conductive center portion.

6. The electrical connector according to claim 5 wherein the first contact blade arm has a first length, the second contact blade arm has a length longer than the first length, and the third contact blade arm has a length shorter than the first length.

7. The electrical connector according to claim 1 wherein the multiplicity of contacts further includes a third contact mounted in a third contact receiving channel adjacent to the second contact receiving channel, the third contact mounting area having a non-conductive center portion, a fourth contact mounted in a fourth contact receiving channel adjacent to the third contact receiving channel, the fourth contact mounting area having a non-conductive center portion, a fifth contact mounted in a fifth contact receiving channel adjacent to the fourth contact receiving channel, the fifth contact mounting area having a non-conductive center portion, a sixth contact mounted in a sixth contact receiving channel adjacent to the fifth contact receiving channel, the sixth contact mounting area having a non-conductive center portion, a seventh contact mounted in a seventh contact receiving channel adjacent to the sixth contact receiving channel, the seventh contact mounting area having a non-conductive center portion, an eighth contact mounted in an eighth contact receiving channel adjacent to the seventh contact receiving channel, the eighth contact mounting area having a non-conductive center portion, and a ninth contact mounted in a ninth contact receiving channel adjacent to the eighth contact receiving channel, the ninth contact mounting area consisting entirely of the electrically conductive material.

8. The electrical connector according to claim 7 wherein the first contact blade arm has a first length, the second, fourth, sixth and eighth contact blade arms have lengths longer than the first length, the third, fifth and seventh contact blade arms have lengths shorter than the first length, and the ninth contact blade arm has a length equivalent to the first length.

9. The electrical connector according to claim 8 wherein the first and ninth contacts facilitate transfer of electrical power and the second, third, fourth, fifth, sixth, seventh and eighth contacts facilitate transfer of digital signals.

10. The electrical connector according to claim 8 wherein the third, fifth, and seventh contacts facilitate transfer of USB 2.0 protocol digital signals and at least some of the second, fourth, sixth, and eighth contacts facilitate transfer of a DisplayPort protocol digital signals.

11. The electrical connector according to claim 1 wherein each of the multiplicity of contacts comprises cut to form sheet metal, wherein the cut to form sheet metal includes applying at least one of a pressing and forming tool, a laser cutting tool, and a milling cutting tool to the sheet metal.

12. The electrical connector according to claim 1 further comprising a cable having a plurality of wires including a first wire attached to the attaching tail of the first contact and a second wire attached to the attaching tail of the second contact.

13. The electrical connector according to claim 1 wherein the multiplicity of contacts further includes a third contact mounted in a third contact receiving channel adjacent to the second contact receiving channel, the third contact mounting area consisting entirely of the electrically conductive material.

14. An electrical connector comprising:

a housing having a row of regularly spaced contact receiving channels; and a multiplicity of contacts comprising an electrically conductive material and mounted in the contact receiving channels, each contact having a blade arm, an attaching tail, and a mounting area between the blade arm and the attaching tail, the mounting area having a top edge and a bottom edge for making an interference fit with the housing, the multiplicity of contacts including a multiplicity of high bandwidth contacts for facilitating communication of high bandwidth data, the high bandwidth contacts mounted in a multiplicity contact receiving channels, at least some of the multiplicity of high bandwidth contacts for transferring digital signals of up to a first data rate, wherein each high bandwidth contact has a mounting area consisting of electrically conductive material except for a non-conductive portion in a center of the mounting area thereof, and a plurality of low bandwidth contacts for facilitating communication of low bandwidth data, the low bandwidth contacts mounted in a plurality of contact receiving channels adjacent to and interposed between the multiplicity of contact receiving channels, at least some of plurality of low bandwidth contacts for transferring digital signals of up to a second data rate lower than the first data rate, wherein each low bandwidth contact has a mounting area consisting entirely of electrically conductive material without having a non-conductive center portion in a center of the mounting area.

15. The electrical connector according to claim 14 wherein at least some of the multiplicity of high bandwidth contacts facilitate a transfer of a DisplayPort digital signaling protocol, the plurality of low bandwidth contacts facilitates a transfer of a USB 2.0 digital signaling protocol.

16. The electrical connector according to claim 14 wherein the multiplicity of contacts further includes a pair of power transfer contacts mounted in a pair of contact receiving channels, each of the pair of power transfer contact mounting areas consisting entirely of electrically conductive material, wherein the multiplicity of high bandwidth contacts and the plurality of low bandwidth contacts are interposed between the pair of power transfer contacts, and each of the pair of power transfer contacts is adjacent to one of the multiplicity of high bandwidth contacts.

17. The electrical connector according to claim 16 wherein the pair of power transfer contacts includes two contacts, each having a blade arm of a first length, the multiplicity of high bandwidth contacts include four contacts, each having a blade arm of a second length greater than the first length, the plurality of low bandwidth contacts includes three contacts, each having a blade arm of a third length shorter than the first length.

18. The electrical connector according to claim 16 wherein the contact receiving channels are regularly spaced with a center-to-center spacing of 0.325 mm, wherein the mounting area of the multiplicity of high bandwidth contacts, the plurality of low bandwidth contacts, and the pair of power transfer contacts ranges between 5.3 $mm^2$ and 5.6 $mm^2$, and wherein the non-conductive portion of the multiplicity of high bandwidth contacts occupies between 23% and 25% of the mounting area.

19. The electrical connector according to claim 18 wherein each of the multiplicity of contacts comprises cut to form sheet metal, wherein the cut to form sheet metal includes applying at least one of a pressing and forming tool, a laser cutting tool, and a milling cutting tool to the sheet metal.

20. An electrical connector comprising:

a housing having a row of regularly spaced contact receiving channels; and a multiplicity of contacts comprising an electrically conductive material and mounted in the contact receiving channels, each contact having a blade arm, an attaching tail, and a mounting area between the blade arm and the attaching tail, the mounting area having a top edge and a bottom edge for making an interference fit with the housing, the multiplicity of contacts including a plurality of low bandwidth contacts mounted in a first plurality of contact receiving channels, each mounting area of each low bandwidth contact consisting entirely of the electrically conductive material, without having a non-conductive center portion in a center of the mounting area, and each blade arm of each low bandwidth contact having a first length, and a plurality of high bandwidth contacts mounted in a second plurality of contact receiving channels, each mounting area of each high bandwidth contact having a single non-conductive center portion that occupies at least 23% of the mounting area thereof, and each blade arm of each high bandwidth contact having a second length that is greater than the first length.

* * * * *